US009953559B2

(12) United States Patent
Wang et al.

(10) Patent No.: US 9,953,559 B2
(45) Date of Patent: Apr. 24, 2018

(54) SOURCE DRIVER, DRIVING CIRCUIT AND DRIVING METHOD FOR TFT-LCD

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Hui Wang, Beijing (CN); Wei Feng, Beijing (CN); Hengzhen Liang, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 79 days.

(21) Appl. No.: 15/037,217

(22) PCT Filed: Sep. 24, 2015

(86) PCT No.: PCT/CN2015/090496
§ 371 (c)(1),
(2) Date: May 17, 2016

(87) PCT Pub. No.: WO2016/201818
PCT Pub. Date: Dec. 22, 2016

(65) Prior Publication Data

US 2017/0169754 A1 Jun. 15, 2017

(30) Foreign Application Priority Data

Jun. 19, 2015 (CN) ..... 2015 1 0343670

(51) Int. Cl.
*G09G 3/20* (2006.01)
*G09G 3/36* (2006.01)

(52) U.S. Cl.
CPC ..... *G09G 3/2018* (2013.01); *G09G 3/3688* (2013.01); *G09G 2300/0814* (2013.01);
(Continued)

(58) Field of Classification Search
CPC ..... G09G 2310/027; G09G 2310/0251; G09G 2300/0828; G09G 2300/0814;
(Continued)

(56) References Cited

U.S. PATENT DOCUMENTS

2002/0041263 A1* 4/2002 Aoki ..... G09G 3/3614 345/55
2005/0174344 A1* 8/2005 La ..... G02F 1/13306 345/208

(Continued)

FOREIGN PATENT DOCUMENTS

CN 1341916 3/2002
CN 1620628 5/2005

(Continued)

OTHER PUBLICATIONS

Office Action in Chinese Application No. 201510343670.8 dated Dec. 30, 2016, with English translation. 14 pages.

(Continued)

*Primary Examiner* — Abhushek Sarma
(74) *Attorney, Agent, or Firm* — Blakely Sokoloff Taylor & Zafman LLP

(57) ABSTRACT

The present invention provides a source driver for use in a TFT-LCD, comprising: a data register, a data latch, a digital-to-analog converter and an output buffer. A first loading pulse is provided to the output buffer, such that the output buffer starts to output the gray-scale voltages of odd output ends to corresponding TFT sources in response to a second edge of the first loading pulse from the second level to the first level, which second edge immediately follows the first (Continued)

edge, and a second loading pulse is provided to the output buffer, such that such that the output buffer starts to output the gray-scale voltages of even output ends to corresponding TFT sources in response to a second edge of the second loading pulse from the second level to the first level, which second edge immediately follows the first edge. At least the second edge of the first loading pulse is not synchronous with the second edge of the second loading pulse. A driving circuit and a driving method are further provided. The source driver, the driving circuit and the driving method can alleviate adverse consequences resulting from too large difference between display data of two adjacent rows.

18 Claims, 3 Drawing Sheets

(52) U.S. Cl.
CPC ..... *G09G 2300/0828* (2013.01); *G09G 2310/0251* (2013.01); *G09G 2310/0291* (2013.01); *G09G 2310/08* (2013.01); *G09G 2320/0209* (2013.01)

(58) Field of Classification Search
CPC ..... G09G 2310/08; G09G 3/2018; G09G 3/3688; G09G 2320/0209; G09G 2310/0291
See application file for complete search history.

(56) References Cited

U.S. PATENT DOCUMENTS

| | | | | |
|---|---|---|---|---|
| 2007/0159439 | A1 | 6/2007 | Park | |
| 2009/0121998 | A1* | 5/2009 | Ohkawa ..... | G09G 3/3688 345/100 |

FOREIGN PATENT DOCUMENTS

| | | | |
|---|---|---|---|
| CN | 101336447 | | 12/2008 |
| CN | 102157126 | A | 8/2011 |
| CN | 102629445 | A | 8/2012 |
| CN | 103093733 | A | 5/2013 |
| CN | 104424898 | A | 3/2015 |
| CN | 104867474 | | 8/2015 |
| JP | 2001324967 | | 11/2001 |

OTHER PUBLICATIONS

Office Action in Chinese Application No. 201510343670.8 dated Jun. 26, 2017, with English translation.
International Search Report and Written Opinion with English Language Translation, dated Mar. 24, 2016, Application No. PCT/CN2015/090496.

* cited by examiner

SOURCE DRIVER, DRIVING CIRCUIT AND DRIVING METHOD FOR TFT-LCD

TECHNICAL FIELD

The present invention relates to the technical field of liquid crystal display, and particularly to a source driver, a driving circuit and a driving method for TFT-LCD.

BACKGROUND

The thin film transistor liquid crystal display (TFT-LCD) is widely used in consumer electronics such as television, computer, mobile phone and the like. Usually, the TFT-LCD comprises a liquid crystal panel having pixel units arranged in a matrix, wherein the driving circuit is provided to drive the pixel units to display.

FIG. 1 schematically illustrates a circuit block diagram of a typical TFT-LCD. Referring to FIG. 1, the TFT-LCD device comprises a liquid crystal panel having m×n pixel units arranged in a matrix, m source lines (also called data lines) S1 to Sm and n gate lines G1 to Gn which are intersected with each other and thin film transistors arranged at points where the data lines and the gate lines intersect, source drivers for providing data to the data lines S1 to Sm of the liquid crystal panel, and gate drivers for providing scan pulses to the gate lines G1 to Gn. The gate drivers outputs, in response to a clock signal, the scan pulses on the gate lines G1, G2, . . . Gn (also called scan lines) successively to control turning-on and turning-off of the TFTs on respective gate lines, and the source drivers converts the display data into gray-scale voltages when the TFTs are turned on, so as to charge the pixel units to enable display of data.

The TFT-LCD currently develops towards large size and high resolution. Since the large size of the panel would lead to large RC of the gate lines and the common electrode lines, if there is a large difference between display data (i.e. gray-scale voltages) in two adjacent rows, it would cause the loading capacity of the source driver to be insufficient. Moreover, the VCOM voltage would be affected due to a sudden change in the gray-scale voltages such that the voltage applied on the pixel units is instable. These always result in unfavorable display effects such as artifact and crosstalk.

Therefore, there is a demand for an improved source driver and corresponding driving circuit and driving method for the TFT-LCD.

SUMMARY

The present invention seeks to avoid insufficient loading capacity of the source driver and/or unfavorable display effects such as artifact and crosstalk resulting from too large difference between display data of two adjacent rows.

In accordance with a first aspect of the present invention, it is provided that a source driver for use in a TFT-LCD, comprising:

a data register for registering multiple display data, the multiple display data corresponding to a plurality of pixel units in a row of pixel units of the TFT-LCD; a data latch having a first terminal for receiving a first loading pulse and a second terminal for receiving a second loading pulse, the data latch latching the multiple display data in the data register in response to a first edge of the first loading pulse from a first level to a second level and a first edge of the second loading pulse from a first level to a second level; a digital-to-analog converter for converting the multiple display data latched in the data latch into corresponding multiple gray-scale voltages; and an output buffer comprising a plurality of buffer units, for outputting the multiple gray-scale voltages via output ends of the plurality of buffer units; wherein the first loading pulse is provided to the output buffer to enable the output buffer to start to output gray-scale voltages of odd output ends to corresponding TFT sources in response to a second edge of the first loading pulse from the second level to the first level, which second edge immediately follows the first edge, and wherein the second loading pulse is provided to the output buffer to enable the output buffer to start to output gray-scale voltages of even output ends to corresponding TFT sources in response to a second edge of the second loading pulse from the second level to the first level, which second edge immediately follows the first edge; at least the second edge of the first loading pulse is not synchronous with the second edge of the second loading pulse.

In accordance with a second aspect of the present invention, it is provided that a driving circuit for use in a TFT-LCD, comprising: at least one source driver according to the first aspect of the present invention; and a timing controller for providing a first loading pulse and a second loading pulse to the at least one source driver.

In accordance with a third aspect of the present invention, it is provided that a driving method for use in a TFT-LCD, comprising: providing a first loading pulse and a second loading pulse; latching multiple display data according to a first edge of the first loading pulse from a first level to a second level and a first edge of the second loading pulse from a first level to a second level; converting the latched multiple display data into corresponding multiple gray-scale voltages; and outputting the multiple gray-scale voltages via output ends of a plurality of buffer units of an output buffer; wherein outputting the multiple gray-scale voltages comprises: providing the first loading pulse to the output buffer to enable the output buffer to start to output the gray-scale voltages of odd output ends to corresponding TFT sources according to a second edge of the first loading pulse from a second level to a first level, which second edge immediately follows the first edge, and providing the second loading pulse to the output buffer to enable the output buffer to start to output the gray-scale voltages of even output ends to corresponding TFT sources according to a second edge of the second loading pulse from the second level to the first level, which second edge immediately follows the first edge; at least the second edge of the first loading pulse is not synchronous with the second edge of the second loading pulse.

The present invention allows the odd column pixels and the even column pixels not being charged simultaneously by providing two sets of asynchronous loading pulses (TP signals), which can relieve overloading of the source driver (and therefore insufficient charging of pixel electrodes) resulting from too large difference between display data of two adjacent rows and alleviate the pull effect on the VCOM voltage due to a sudden change in pixel voltages. More generally, the present invention can reduce picture quality losses such as artifact and crosstalk of the large-size liquid crystal display.

In accordance with the embodiments described below, these and other aspects of the present invention will be apparent and set forth from and with reference to the embodiments described below.

DETAILED DESCRIPTION OF THE INVENTION

Embodiments of the present invention are described in detail below with reference to the drawings.

Figure 1:
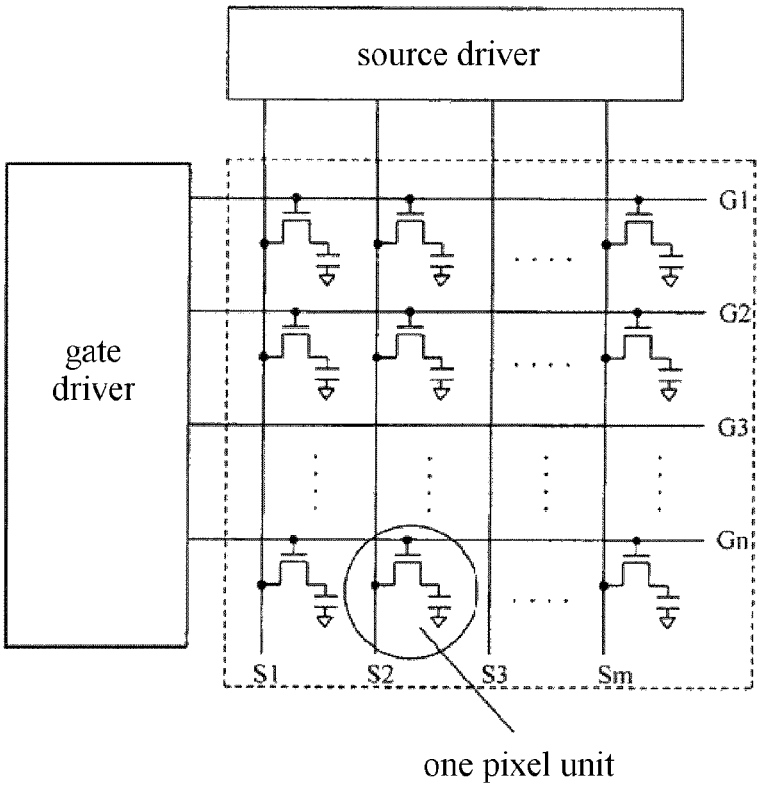
FIG. 1 schematically illustrates a circuit block diagram of a typical TFT-LCD.
Figure 2:
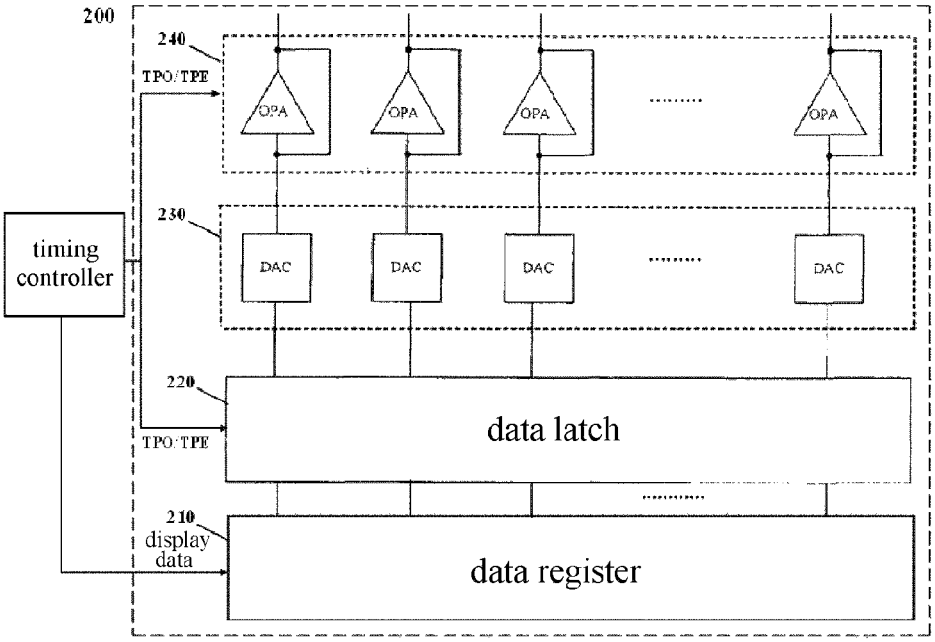
FIG. 2 schematically illustrates a block diagram of a source driver for use in a TFT-LCD in accordance with an embodiment of the present invention.

FIG. 2 schematically illustrates a block diagram of a source driver 200 for use in a TFT-LCD in accordance with an embodiment of the present invention. For the purpose of explanation, only elements relevant to the embodiment of the present invention are shown, while elements irrelevant to the embodiment of the present invention, such as shift register, level shifter, gray-scale voltage generation circuit, etc. are omitted. Like this, the source driver 200 may comprise a data register 210, a data latch 220, a digital-to-analog converter 230 and an output buffer 240. In addition, as known in the art, a timing controller is a part of the driving circuit of the TFT-LCD, which may provide the source driver 200 with signals including a video/image signal (display data) and a clock signal.

As shown in FIG. 2, the source driver 200 actually comprises a plurality of output channels (corresponding to a plurality of columns) from the data register 210 to the output buffer 240, each of which is connected to the source of the TFT in a different column of pixel units. When the current row is scanned, the scan pulse from a gate driver controls the TFTs in all the pixel units of this row to become turned on. At that time, the output signal from each output channel charges the pixel electrodes in the pixel units in the current row, realizing driving of the liquid crystal panel.

The data register 210 may comprise a plurality of register units for registering multiple display data. The number of the plurality of register units corresponds to the number of the output channels of the source driver 200. In an example, suppose that the source driver 200 has 384 output channels, the data register 210 may have 384 register units. Depending on the bit width of the display data, each register unit may be implemented by, for example, a plurality of transparent latches.

The data latch 220 may comprise a plurality of latch units. The plurality of latch units may generally latch multiple display data in the data register 210 in response to the rising edge of a loading pulse (TP signal). In accordance with the above supposed example, the data latch 200 may comprise 384 latch units. In the present embodiment, the loading pulse may comprise a first loading pulse and a second loading pulse (discussed below), and the data latch 220 may have a first terminal (not shown) for receiving the first loading pulse and a second terminal (not shown) for receiving the second loading pulse. The data latch 220 may latch the multiple display data in the data register in response to a first edge of the first loading pulse from a first level to a second level and a first edge of the second loading pulse from a first level to a second level. Specifically, the data latch 220 may latch the display data of the data register 210 corresponding to odd output channels in response to a first edge of the first loading pulse from a first level to a second level, and latch the display data of the data register 210 corresponding to even output channels in response to a first edge of the second loading pulse from a first level to a second level.

The digital-to-analog converter 230 may comprise a plurality of digital-to-analog converter (DAC) units. The digital-to-analog converter (DAC) units may convert the multiple display data latched in the data latch 220 into corresponding multiple gray-scale voltages. In accordance with the above supposed example, the digital-to-analog converter 230 may comprise 384 digital-to-analog converter (DAC) units. It should be understood that the digital-to-analog converter 230 may usually perform digital-to-analog conversion by selecting analog voltages generated by a gray-scale voltage generation circuit (not shown) to which the digital data correspond.

The output buffer 240 may comprise a plurality of buffer units. The plurality of buffer units may output the multiple gray-scale voltages selected by the digital-to-analog converter 230 via a plurality of output ends. In accordance with the above supposed example, the output buffer 240 may comprise 384 buffer units. The respective gray-scale voltages outputted from these buffer units are provided to the pixel electrodes (via the TFTs in the pixel units) to control the deflection of liquid crystal molecules, thereby enabling display of data. In the example of FIG. 2, these buffer units are illustrated as voltage followers formed by operational amplifiers OPA, though it may not be the case.

Figure 3:
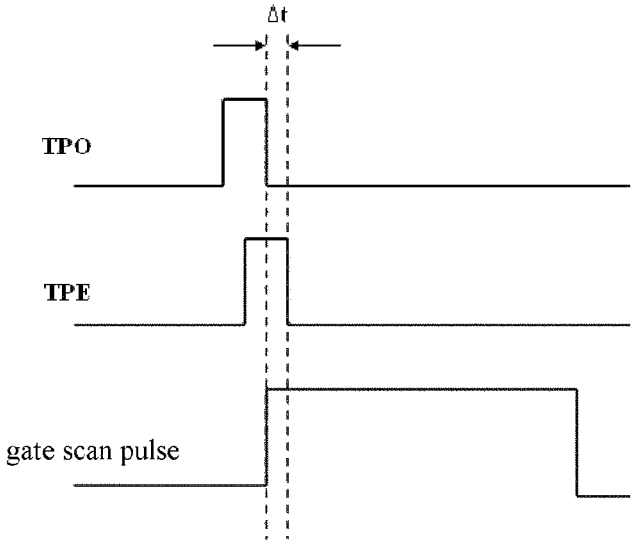
FIG. 3 schematically illustrates a timing relationship between a first loading pulse, a second loading pulse and a gate scan pulse for use in the source driver in accordance with an embodiment of the present invention.

FIG. 3 schematically illustrates a timing relationship between a first loading pulse TPO, a second loading pulse TPE and a gate scan pulse for use in the source driver 200 in accordance with an embodiment of the present invention. The first loading pulse TPO is a loading pulse corresponding to the odd output channels, and the second loading pulse TPE is a loading pulse corresponding to the even output channels.

The embodiments of the present invention are further described below with reference to FIGS. 2 and 3. In FIG. 3, the second loading pulse TPE is illustrated as a delayed version of the first loading pulse TPO (that is, the second loading pulse TPE is obtained by delaying the first loading pulse TPO). In this case, the source driver 200 may comprise a delay circuit (not shown) for delaying the original loading pulse TP (from the timing controller) by a predetermined amount of time. In this way, the original loading pulse TP may act as the first loading pulse TPO, and a delayed version of the original loading pulse TP may act as the second loading pulse TPE. The first loading pulse TPO is provided to the buffer units in the odd output channels of the output buffer 240 such that those buffer units may start to output the gray-scale voltages of odd output ends to corresponding TFT sources in response to a second edge (e.g. falling edge) of the first loading pulse TPO from the second level to the first level. The second loading pulse TPE is provided to the buffer units in the even output channels of the output buffer 240 such that those buffer units may start to output the gray-scale voltages of even output ends to corresponding TFT sources in response to a second edge (e.g. falling edge) of the second loading pulse TPE. As shown in FIG. 3, the second edge of the first loading pulse TPO is not synchronous with the second edge of the second loading pulse TPE. A time interval $\Delta t$ between the two edges may be set depending on the driving ability of the source driver, and is generally set so as to satisfy an expected TFT charging rate.

For instance, for the resolution of 3840×2160, the time interval Δt may be between 0.5 μs and 0.8 μs.

In an implementation, the first level of the first loading pulse TPO may be used as an enable signal for the odd buffer units of the output buffer 240 to enable the outputting of the gray-scale voltages from the odd output ends, and the first level of the second loading pulse TPE may be used as an enable signal for even buffer units of the output buffer 240 to enable the outputting of the gray-scale voltages from the even output ends.

In an alternative implementation, the output buffer 240 may further comprise a plurality of switch elements (not shown). Each of the plurality of switch elements is connected in series with a respective one of the output ends of the plurality of buffer units of the output buffer 240. The first loading pulse TPO may be provided to control ends of the switch elements connected in series with the odd output ends such that these switch elements are turned on under the first level of the first loading pulse TPO. Similarly, the second loading pulse TPE may be provided to control ends of the switch elements connected in series with the even output ends such that these switch elements are turned on under the first level of the second loading pulse TPE. By way of example without limitation, the switch element may be a thin film transistor, a transmission gate, and so on.

It is to be noted that in the example of FIG. 3, the first level is a low level and the second level is a high level. However, in other implementations, it may not be the case. For example, the first level may be a high level and the second level may be a low level. In addition, the rising edge of the first loading pulse TPO and the rising edge of the second loading pulse TPE are illustrated as being not synchronous. However, in other implementations, it may not be the case, that is, the two rising edges may be synchronous. Furthermore, the falling edge of the first loading pulse TPO is illustrated as occurring before the falling edge of the second loading pulse TPE, though it may not be the case. That is, the falling edge of the second loading pulse TPE may occur before the falling edge of the first loading pulse TPO. For example, the first loading pulse TPO may be a delayed version of the second loading pulse TPE.

Since the first loading pulse TPO and the second loading pulse TPE are not synchronous, the pixel units in odd columns and the pixel units in even columns are not charged simultaneously, which alleviates adverse consequences resulting from (possible) too large difference between display data of two adjacent rows.

What is discussed above is the situation in which the first loading pulse TPO and the second loading pulse TPE which are not synchronous are always provided, regardless of the actual difference between display data of two adjacent rows. However, in accordance with another embodiment of the present invention, a certain determination mechanism may be introduced such that two loading pulses not synchronous are provided only when the difference between display data of two adjacent rows is determined to be too large; otherwise, the same (original) loading pulse is provided to the pixel units in odd columns and the pixel units in even columns.

Figure 4:
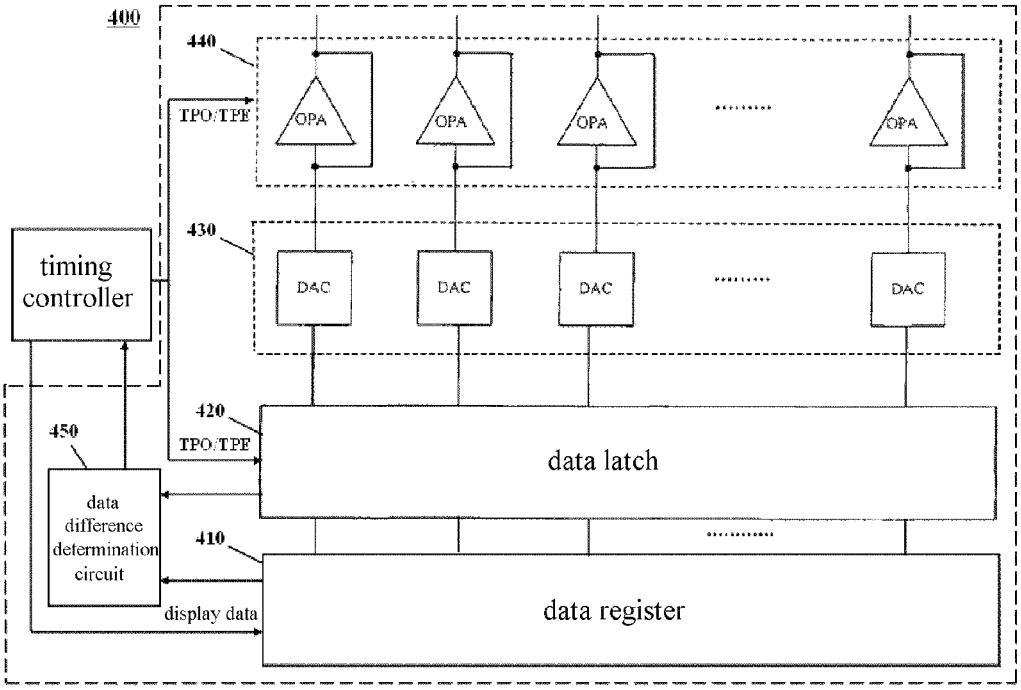
FIG. 4 schematically illustrates a block diagram of a source driver for use in a TFT-LCD in accordance with another embodiment of the present invention.

FIG. 4 schematically illustrates a block diagram of a source driver 400 for use in a TFT-LCD in accordance with another embodiment of the present invention. In this figure, a data register 410, a data latch 420, a digital-to-analog converter 430 and an output buffer 440 respectively correspond to the data register 210, the data latch 220, the digital-to-analog converter 230 and the output buffer 240 in FIG. 2, and they all will not be described in detail for simplicity.

The source driver 400 may comprise a data difference determination circuit 450, which can determine, upon updating a row of display data, whether the difference between multiple display data in the (n+1)-th row as registered in the data register 410 and multiple display data in the n-th row as latched in the data latch 420 is large or not. For example, in accordance with the above supposed example, each of the data register 410 and the data latch 420 stores 384 display data (corresponding to 384 columns), all of which is inputted to the data difference determination circuit 450 where the difference between two display data on each column is calculated and then compared with a first predetermined threshold so as to obtain a determination result about the difference between display data of two adjacent rows. According to different determination results, the data difference determination circuit 450 provides different inputs to the timing controller (as shown in FIG. 4). The input may be a high level or low level representing a different logical value. For example, the high level may represent large difference between the display data of the (n+1)-th row and the display data of the n-th row. Thereafter, according to the input from the data difference determination circuit 450, the timing controller may provide or may not provide the first loading pulse TPO and the second loading pulse TPE. As stated above, the first loading pulse TPO and the second loading pulse TPE which are not synchronous are provided only when the input indicates that the difference between the display data of the (n+1)-th row and the display data of the n-th row is large; otherwise, a same loading pulse is provided. It should be further understood that said "large difference" may indicate that at least one or more of respective differences between the multiple display data in the (n+1)-th row and the multiple display data in the n-th row is larger than the first predetermined threshold.

Figure 5:
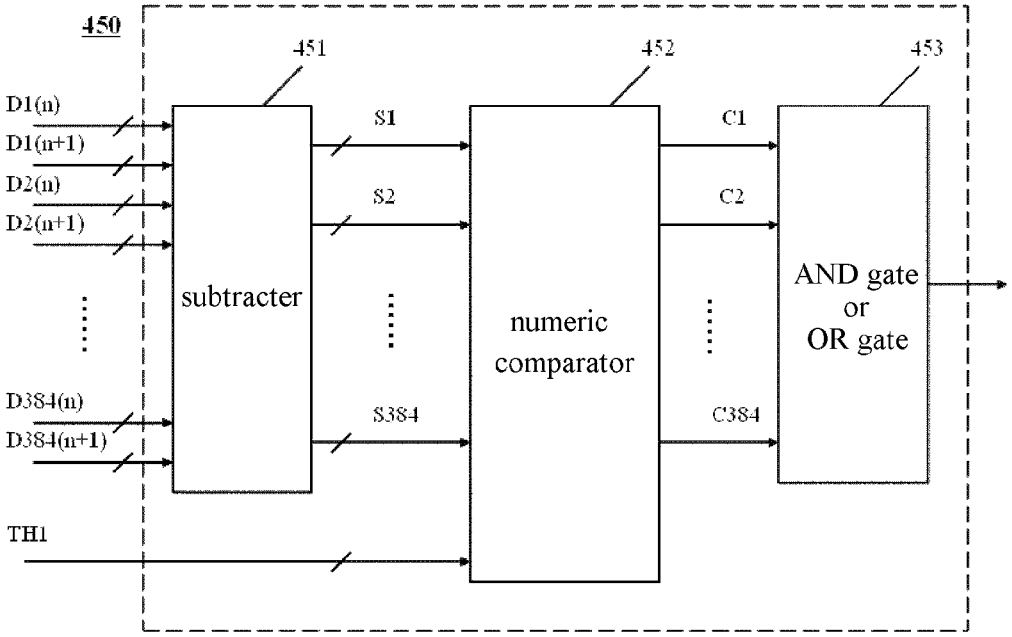
FIG. 5 schematically illustrates a block diagram of an implementation of the data difference determination circuit shown in FIG. 4.

FIG. 5 schematically illustrates a block diagram of an implementation of the data difference determination circuit 450 shown in FIG. 4. In the implementation, the data difference determination circuit 450 may comprise a subtracter 451 that may perform subtraction between the multiple display data in the (n+1)-th row and the multiple display data in the n-th row, respectively and a first numeric comparator 452 that may compare each of the subtraction results with the first predetermined threshold TH1, respectively. In accordance with the above supposed example, the 384 display data D1($n$+1), D2($n$+1), . . . D384($n$+1) in the (n+1)-th row and the 384 display data D1($n$), D2($n$), . . . D384($n$) in the n-th row are inputted into the subtracter 451 for subtraction, and 384 corresponding differences S1, S2, . . . , S384 are outputted. The 384 differences are then inputted into the first numeric comparator 452 to be compared with the first predetermined threshold TH1. The first numeric comparator 452 can output 384 comparison results C1, C2, . . . , C384 representing different logical relationships (that is, larger, equal or smaller). The implementations of the subtracter and the first numeric comparator are known in the art, which will not be described here in detail.

In the case that said "large difference" indicates that at least one of the differences between the multiple display data in the (n+1)-th row and the multiple display data in the n-th row is larger than the first predetermined threshold, depending on the signal logic as defined (for example, logic "0" may indicate that the difference is larger than the first threshold, or logic "1" may indicate that the difference is larger than the first threshold), the data difference determination circuit 450 may further comprise a first AND gate or first OR gate 453 for performing an AND operation or OR operation for each of the output results of the first numeric comparator 452. The output of the first AND gate or first OR gate 453 may be provided to the timing controller as an input indicating the determination result of the data difference determination circuit 450.

Alternatively, in the case that said "large difference" indicates that at least a predetermined number of the differences between the multiple display data in the (n+1)-th row and the display data in the n-th row is larger than the first predetermined threshold, in another implementation, the data difference determination circuit 450 may comprise an adder for adding every one of the output results of the first numeric comparator and a second numeric comparator for comparing the addition result with a second predetermined threshold. The output of the second numeric comparator is provided to the timing controller as an input indicating the determination result of the data difference determination circuit 450. For example, if logic "0" indicates that the difference is larger than the first threshold, the addition result being smaller than the second predetermined threshold indicates large difference between the multiple display data in the (n+1)-th row and the multiple display data in the n-th row. Alternatively, if logic "1" indicates that the difference is larger than the first threshold, the addition result being larger than the second predetermined threshold indicates large difference between the multiple display data in the (n+1)-th row and the multiple display data in the n-th row. The implementations of the adder and the second numeric comparator are known in the art and will not be described here in detail.

In practice, the source driver usually takes the form of a source driving chip, and the source driving chip, the gate driving chip, the timing controller and other peripheral circuits together constitute a driving circuit for use in the display panel. In the preceding embodiments, the delay circuit is described as a part of the source driver 200, though it may not be the case. For example, the delay circuit may also be a separate circuit as a part of the driving circuit. Furthermore, in the preceding embodiments, the data difference determination circuit 450 is described as a part of the source driver 400, though it may not be the case. For example, the data difference determination circuit 450 may also be a separate circuit as a part of the driving circuit.

Further, there may be a demand for a plurality of cascaded source driving chips when driving a display panel. For example, as for a SXGA display panel with the resolution of 1280×1024, a row of display data corresponds to 1280×3=3840 pixel units (because one pixel comprises three pixel units of R, G, B), at that time, in accordance with the above supposed example (i.e. a source driving chip having 384 outputs), 10 cascaded source driving chips are required to drive the SXGA display panel. In the case of a plurality of source driving chips, depending on the signal logic as defined (for example, logic "0" may indicate large difference between the multiple display data in the (n+1)-th row and the multiple display data in the n-th row; or logic "1" may indicate the large difference), the driving circuit may further comprise a second AND gate or second OR gate for performing an AND operation or OR operation for the outputs from the data difference determination circuit of each of the plurality of source driving chips. The output of the second AND gate or second OR gate may be provided to the timing controller as a final determination result indicating the difference between display data of two adjacent rows.

Corresponding to the above embodiments described with reference to FIGS. 2 to 5, another embodiment of the present invention further provides a driving method for use in a TFT-LCD, comprising: providing a first loading pulse TPO and a second loading pulse TPE; latching multiple display data according to a first edge of the first loading pulse TPO from a first level to a second level and a first edge of the second loading pulse TPE from a first level to a second level; converting the latched multiple display data into corresponding multiple gray-scale voltages; and outputting the multiple gray-scale voltages via output ends of a plurality of buffer units of an output buffer 240, 440; wherein outputting the multiple gray-scale voltages comprises: providing the first loading pulse TPO to the output buffer 240, 440 such that the output buffer 240, 440 starts to output the gray-scale voltages of odd output ends to corresponding TFT sources according to a second edge of the first loading pulse TPO from the second level to the first level, which second edge immediately follows the first edge, and providing the second loading pulse TPE to the output buffer 240, 440 such that the output buffer 240, 440 starts to output the gray-scale voltages of even output ends to corresponding TFT sources according to a second edge of the second loading pulse TPE from the second level to the first level, which second edge immediately follows the first edge. At least the second edge of the first loading pulse TPO is not synchronous with the second edge of the second loading pulse TPE.

It should be understood that other features and advantages of the driving method have been embodied in the preceding description of the source driver 200, 400 and the driving circuit, and hence are not described here in detail.

Although the preceding discussion includes several specific implementation details, these should not be construed as limitation to any invention or scope possibly claimed, but should be construed as description of the features only limited to specific embodiments of specific inventions. The specific features described in different embodiments of the present specification may also be implemented in the form of combinations in a single embodiment. On the contrary, different features described in a single embodiment may also be implemented separately in multiple embodiments or in any suitable form of sub-combination. In addition, although the features are described previously as functioning in specific combinations, even initially claimed in this way, one or more features from the claimed combination may also be excluded from the combination in some cases, and the claimed combination may be directed to sub-combinations or variants of sub-combinations.

In view of the preceding description in conjunction with reading the drawings, various amendments and modifications to the preceding illustrative embodiments of the present invention may become obvious for the skilled persons of relevant arts. Any and all amendments will still fall within the scopes of the non-limiting and illustrative embodiments of the present invention. In addition, the skilled persons in the field to which these embodiment of the invention belong, upon benefiting from the teachings given by the preceding description and relevant drawings, would conceive of other embodiments of the present invention described herein.

Therefore, it should be understood that the embodiments of the present invention are not limited to the specific ones as disclosed, and amendments and other embodiments are also intended to be included within the scope of the appended Claims. Although specific terms are used herein, they are only used in general and descriptive sense, not for the purpose of limitation.

The invention claimed is:

1. A source driver for use in a TFT-LCD, comprising:

a data register for registering multiple display data, the multiple display data corresponding to a plurality of pixel units in a row of pixel units of the TFT-LCD;

a data latch having a first terminal for receiving a first loading pulse and a second terminal for receiving a second loading pulse, the data latch latching the multiple display data in the data register in response to a first edge of the first loading pulse from a first level to a second level and a first edge of the second loading pulse from a first level to a second level;

a digital-to-analog converter for converting the multiple display data latched in the data latch into corresponding multiple gray-scale voltages;

an output buffer comprising a plurality of buffer units, for outputting the multiple gray-scale voltages via output ends of the plurality of buffer units; and a data difference determination circuit for determining, upon updating a row of display data, whether at least one of respective differences between multiple display data in an (n+1)-th row as registered in the data register and multiple display data in an n-th row as latched in the data latch is larger than a first predetermined threshold, the data difference determination circuit comprising a subtracter for performing subtraction between the multiple display data in the (n+1)-th row and the multiple display data in the n-th row, respectively and a first numeric comparator for comparing each of subtraction results with the first predetermined threshold, respectively, where n is greater than 0;

wherein the data difference determination circuit is configured to provide different inputs to a timing controller of the TFT-LCD according to different determination results, wherein the first loading pulse is provided to the output buffer to enable the output buffer to start to output gray-scale voltages of odd output ends to corresponding TFT sources in response to a second edge of the first loading pulse from the second level to the first level, which second edge immediately follows the first edge, and wherein the second loading pulse is provided to the output buffer to enable the output buffer to start to output gray-scale voltages of even output ends to corresponding TFT sources in response to a second edge of the second loading pulse from the second level to the first level, which second edge immediately follows the first edge; at least the second edge of the first loading pulse being not synchronous with the second edge of the second loading pulse.

2. The source driver according to claim 1, wherein the first level of the first loading pulse is used as an enable signal for odd buffer units of the output buffer to enable outputting of the gray-scale voltages from the odd output ends, and the first level of the second loading pulse is used as an enable signal for even buffer units of the output buffer to enable outputting of the gray-scale voltages from the even output ends.

3. The source driver according to claim 1, wherein the output buffer further comprises a plurality of switch elements each connected in series with a respective one of the output ends of the plurality of buffer units of the output buffer, wherein the first loading pulse is provided to control ends of the switch elements connected in series with the odd output ends such that the switch elements connected in series with the odd output ends are turned on under the first level of the first loading pulse, and wherein the second loading pulse is provided to control ends of the switch elements connected in series with the even output ends such that the switch elements connected in series with the even output ends are turned on under the first level of the second loading pulse.

4. The source driver according to claim 1, wherein the data difference determination circuit further comprises a first AND gate or first OR gate for performing an AND operation or OR operation for each of output results of the first numeric comparator, and an output of the first AND gate or first OR gate is provided to the timing controller as the input indicating a determination result of the data difference determination circuit.

5. The source driver according to claim 1, wherein the data difference determination circuit further comprises an adder for adding every one of the output results of the first numeric comparator and a second numeric comparator for comparing an addition result with a second predetermined threshold, and an output of the second numeric comparator is provided to the timing controller as the input indicating a determination result of the data difference determination circuit.

6. The source driver according to claim 1, wherein one of the first loading pulse and the second loading pulse is obtained by delaying the other.

7. A driving circuit for use in a TFT-LCD, comprising:

at least one source driver according to claim 1; and a timing controller for providing a first loading pulse and a second loading pulse to the at least one source driver.

8. The driving circuit according to claim 7, wherein the timing controller is configured to provide the first loading pulse to the output buffer to use the first level of the first loading pulse as an enable signal for odd buffer units of the output buffer to enable outputting of the gray-scale voltages from odd output ends, and to provide the second loading pulse to the output buffer to use the first level of the second loading pulse as an enable signal for even buffer units of the output buffer to enable outputting of the gray-scale voltages from even output ends.

9. The driving circuit according to claim 7, wherein the output buffer further comprises a plurality of switch elements each connected in series with a respective one of output ends of the plurality of buffer units of the output buffer, and wherein the timing controller is configured to provide the first loading pulse to the control ends of the switch elements connected in series with the odd output ends such that the switch elements connected in series with the odd output ends are turned on under the first level of the first loading pulse, and to provide the second loading pulse to the control ends of the switch elements connected in series with the even output ends such that the switch elements connected in series with the even output ends are turned on under the first level of the second loading pulse.

10. The driving circuit according to claim 7, wherein the data difference determination circuit further comprises a first AND gate or first OR gate for performing an AND operation or OR operation for each of output results of the first numeric comparator, an output of the first AND gate or first OR gate being provided to the timing controller as the input indicating a determination result of the data difference determination circuit.

11. The driving circuit according to claim 7, wherein the data difference determination circuit further comprises an adder for adding every one of the output results of the first numeric comparator and a second numeric comparator for comparing an addition result with a second predetermined threshold, an output of the second numeric comparator being provided to the timing controller as the input indicating a determination result of the data difference determination circuit.

12. The driving circuit according to claim 10, wherein in the case of a plurality of source drivers, the driving circuit further comprises a second AND gate or second OR gate for performing an AND operation or OR operation for outputs from the data difference determination circuit of each of the plurality of source drivers, an output of the second AND gate or second OR gate being provided to the timing controller as the input indicating a final determination result of the data difference determination circuit.

13. The driving circuit according to claim 11, wherein in the case of a plurality of source drivers, the driving circuit further comprises a second AND gate or second OR gate for performing an AND operation or OR operation for outputs from the data difference determination circuit of each of the plurality of source drivers, an output of the second AND gate or second OR gate being provided to the timing controller as the input indicating a final determination result of the data difference determination circuit.

14. The driving circuit according to claim 7, wherein one of the first loading pulse and the second loading pulse is obtained by delaying the other.

15. A driving method for use in a TFT-LCD, comprising:

determining, upon updating a row of display data, whether at least one of respective differences between multiple display data in an (n+1)-th row and multiple display data in an n-th row is larger than a first predetermined threshold, where n is greater than 0;

providing a first loading pulse and a second loading pulse in response to the determination indicates that the at least one difference is larger than the first predetermined threshold;

latching multiple display data according to a first edge of the first loading pulse from a first level to a second level and a first edge of the second loading pulse from a first level to a second level;

converting the multiple display data as latched into corresponding multiple gray-scale voltages; and outputting the multiple gray-scale voltages via output ends of a plurality of buffer units of an output buffer;

wherein outputting the multiple gray-scale voltages comprises:

providing the first loading pulse to the output buffer to enable the output buffer to start to output the gray-scale voltages of odd output ends to corresponding TFT sources according to a second edge of the first loading pulse from a second level to a first level, which second edge immediately follows the first edge, and providing the second loading pulse to the output buffer to enable the output buffer to start to output the gray-scale voltages of even output ends to corresponding TFT sources according to a second edge of the second loading pulse from the second level to the first level, which second edge immediately follows the first edge; at least the second edge of the first loading pulse being not synchronous with the second edge of the second loading pulse.

16. The driving method according to claim 15, wherein providing the first loading pulse to the output buffer comprises: using the first level of the first loading pulse as an enable signal for odd buffer units of the output buffer to enable outputting of the gray-scale voltages from odd output ends, and wherein providing the second loading pulse to the output buffer comprises: using the first level of the second loading pulse as an enable signal for even buffer units of the output buffer to enable outputting of the gray-scale voltages from even output ends.

17. The driving method according to claim 15, further comprising providing a plurality of switch elements, each of the plurality of switch elements being connected in series with a respective one of the output ends of the plurality of buffer units of the output buffer, wherein providing the first loading pulse to the output buffer comprises: providing the first loading pulse to the control ends of the switch elements connected in series with the odd output ends such that the switch elements connected in series with the odd output ends are turned on under the first level of the first loading pulse, and wherein providing the second loading pulse to the output buffer comprises: providing the second loading pulse to the control ends of the switch elements connected in series with the even output ends such that the switch elements connected in series with the even output ends are turned on under the first level of the second loading pulse.

18. The driving method according to claim 15, wherein one of the first loading pulse and the second loading pulse is obtained by delaying the other.

* * * * *